US011794364B1

(12) United States Patent
Danielsson et al.

(10) Patent No.: US 11,794,364 B1
(45) Date of Patent: Oct. 24, 2023

(54) RAZOR BLADE RE-COATING

(71) Applicant: Planet Earth Razors AB, Stockholm (SE)

(72) Inventors: Mats Danielsson, Täby (SE); Sam Hacohen, Haifa (IL); Shlomo Zucker, Mikhmoret (IL); Mark Rutland, Sollentuna (SE); Kathryn Harris, Hägersten (SE)

(73) Assignee: Planet Earth Razors AB, Stockholm (SE)

( * ) Notice: Subject to any disclaimer, the term of this patent is extended or adjusted under 35 U.S.C. 154(b) by 0 days.

(21) Appl. No.: 17/963,364

(22) Filed: Oct. 11, 2022

(51) Int. Cl.

| | |
|---|---|
| ***B26B 21/40*** | (2006.01) |
| ***B24B 3/48*** | (2006.01) |
| ***B05D 7/16*** | (2006.01) |
| ***B05D 5/00*** | (2006.01) |
| *B26B 21/60* | (2006.01) |

(52) U.S. Cl.
CPC ..... *B26B 21/4068* (2013.01); *B05D 5/005* (2013.01); *B05D 7/16* (2013.01); *B24B 3/48* (2013.01); *B26B 21/60* (2013.01)

(58) Field of Classification Search
CPC ..... B26B 21/4068; B26B 21/60; B05D 5/005; B05D 7/16; B24B 3/48
See application file for complete search history.

(56) References Cited

U.S. PATENT DOCUMENTS

| | | | |
|---|---|---|---|
| 4,480,387 | A | 11/1984 | d'Alayer de Costemore d'Arc |
| 4,937,940 | A | 7/1990 | Mason |
| 5,365,958 | A | 11/1994 | Stuhlmacher, II |
| 5,374,813 | A | 12/1994 | Shipp |
| 6,506,106 | B2 | 1/2003 | Fletcher |
| 6,886,211 | B2 | 5/2005 | Severino |
| 6,969,299 | B1 | 11/2005 | Papetti |
| 7,104,874 | B1 | 9/2006 | Gussack et al. |

(Continued)

FOREIGN PATENT DOCUMENTS

| | | | |
|---|---|---|---|
| CA | 1252005 | A | 4/1989 |
| CA | 2261320 | A1 | 8/2000 |

(Continued)

OTHER PUBLICATIONS

Razor Emporium, Razor Revamp Service, pp. 1-11 (2022). [retrieved on Mar. 8, 2022]. Retrieved from the Internet: <URL: https://www.razoremporium.com/razor-revamp-service/>.

(Continued)

*Primary Examiner* — Rick K Chang
(74) *Attorney, Agent, or Firm* — Morgan, Lewis & Bockius LLP

(57) ABSTRACT

A method for re-coating a razor blade (30) of a razor cartridge (10) comprises removing the razor blade (30) attached to a blade support (40) from a housing (20) of the razor cartridge (10). The method also comprises inducing a relative movement between a PTFE material and an edge (32) of the razor blade (30) attached to the blade support (40) to deposit PTFE onto at least a portion of a surface of the edge (32) of the razor blade (30) to form a re-coated razor blade (30) attached to the blade support (40). The method further comprises arranging the re-coated razor blade (30) attached to the blade support (40) into a housing (20) of a razor cartridge (10). A device (100, 200) for re-coating a razor blade (30) is also disclosed.

16 Claims, 7 Drawing Sheets

(56) References Cited

U.S. PATENT DOCUMENTS

| | | | | |
|---|---|---|---|---|
| 7,142,118 | B2 | 11/2006 | Hamilton et al. | |
| 7,263,738 | B2 | 9/2007 | Moore | |
| 9,168,104 | B2 | 10/2015 | Dein | |
| 10,252,829 | B2 | 4/2019 | Coleman et al. | |
| 10,722,018 | B2 | 7/2020 | Kelly | |
| 11,166,535 | B2 | 11/2021 | Lam | |
| 11,338,321 | B2 | 5/2022 | Yu et al. | |
| 2002/0145058 | A1 | 10/2002 | Tziviskos | |
| 2003/0055753 | A1 | 3/2003 | Dellar et al. | |
| 2005/0101231 | A1 | 5/2005 | Sekerich | |
| 2006/0283487 | A1 | 12/2006 | Grabowski | |
| 2008/0006311 | A1 | 1/2008 | Brown et al. | |
| 2009/0000426 | A1 | 1/2009 | Andersen et al. | |
| 2017/0066147 | A1 | 3/2017 | Ball et al. | |
| 2018/0192757 | A1 | 7/2018 | Lam | |
| 2019/0016001 | A1* | 1/2019 | Zucker | B26B 21/4018 |

FOREIGN PATENT DOCUMENTS

| | | | | | |
|---|---|---|---|---|---|
| CN | 101950389 | A | | 1/2011 | |
| CN | 201780584 | U | | 3/2011 | |
| CN | 107116770 | A | * | 9/2017 | B08B 15/04 |
| CN | 104662199 | B | * | 3/2018 | F04C 15/0003 |
| CN | 111104995 | A | | 5/2020 | |
| DE | 102006001559 | A1 | | 7/2007 | |
| JP | 2010-282250 | A | | 12/2010 | |
| KR | 10-2020-0075135 | A | | 6/2020 | |
| WO | 2017/032561 | A2 | | 3/2017 | |

OTHER PUBLICATIONS

Shavesmith, Straight Razor Restoration Services, pp. 1-21 (2022). [retrieved on Mar. 8, 2022]. Retrieved from the Internet: <URL: https://shavesmith.com/product/straight-razor-restoration-services/>.

* cited by examiner

RAZOR BLADE RE-COATING

TECHNICAL FIELD

The present invention generally relates to re-coating of razor blades, and in particular to a method and devices for PTFE re-coating of razor blades.

BACKGROUND

There is a general trend of recycling or reusing consumer products to reduce waste from the consumer products and emission of greenhouse gases in connection with production. One area where this is particularly interesting is within personal grooming care. Most men, and many women, shave parts of their facial and/or body hair on a regular basis. While some consumers use electric razors or entirely disposable ones, the majority of consumers use refill cartridge razors, i.e., a reusable handle that is fitted with a new razor cartridge when the previous one is worn out.

Today, the edges of razor blades are coated to improve the shaving effectiveness of the razor blade. In particular, the coating decreases the pull to cut hair, i.e., decreases the force required to cut the hair and thereby improves the ease and smoothness of shaving. Hair proteins, in particular keratin, tend to adhere to the metal material of the razor blade if uncoated. This cases a pulling at the hair follicle during shaving. The coating reduces this adherence between razor blades and hair proteins. The most common coating of razor blades today is TEFLON®, i.e., polytetrafluoroethylene (PTFE).

The razor cartridge generally consists of plastic polymer and rubber components in addition to the stainless steel razors. The razor cartridges may be, depending on the design of the razor cartridges, very hard to dismantle into individual components by the consumers. It is therefore very hard to recycle the different materials of the razor cartridges in an efficient way. As a consequence, in the best scenario, the used razor cartridges end up in waste facilities for energy production or are used as landfills. The everyday consumption of razor cartridges thereby leads to large emissions during the entire chain from material sourcing, production, transportation and up to disposal.

The razor blades as such are most often not worn out when a consumer disposes a razor cartridge. This means that the razor blades could be re-used several times rather than being disposed if they could be refurbished. A key step in such a refurbishment of the razor blades is to replace the coating at the edges of the razor blades, which has been worn out during use. Hence, if a razor blade is to be refurbished and re-used the at least partly worn-out edge coating needs to be replaced.

There is therefore need for re-coating of razor blades.

SUMMARY

It is a general objective to provide a method and device for re-coating razor blades.

This and other objectives are met by embodiments as disclosed herein.

An aspect of the invention relates to a method for re-coating a razor blade of a razor cartridge. The method comprises removing the razor blade attached to a blade support from a housing of the razor cartridge. The method also comprises inducing a relative movement between a PTFE material and an edge of the razor blade attached to the blade support to deposit PTFE onto at least a portion of a surface of the edge of the razor blade to form a re-coated razor blade attached to the blade support. The method further comprises arranging the re-coated razor blade attached to the blade support into a housing of a razor cartridge.

Another aspect of the invention relates to a device for re-coating a razor blade of a razor cartridge. The device comprises two belt drivers. Each belt driver of the two belt drivers comprises at least two pulleys. At least one pulley of the at least two pulleys is connected to a drive shaft. The belt drivers also comprise a belt looped over the pulleys. An outer surface of the belts comprises a PTFE material and is arranged to engage an edge of a razor blade attached to a blade support. The outer surface of the belts is opposite to an inner surface of the belts engaging the at least two pulleys. The device also comprises a support holder arranged relative to the belt drivers to support the razor blade attached to the blade support and position the edge of the razor blade into contact with the PTFE material of the outer surfaces of the belts of the two belt drivers.

A further aspect of the invention relates to a device for re-coating a razor blade of a razor cartridge. The device comprises two rotatable cylinders comprising a respective lateral surface comprising a PTFE material. The device also comprises a support holder arranged relative to the two rotatable cylinders to support a razor blade attached to a blade support and position an edge of the razor blade between the two rotatable cylinders and into contact with the PTFE material. The device further comprises a motor connected to the two rotatable cylinders and configured to rotate the two rotatable cylinders in opposite rotation directions.

The present invention enables re-coating of already used razor blades with a fresh PTFE (TEFLON®) edge coating. The re-coated razor blades can thereby re-used, which reduces the environmental impact of razors that are otherwise wasted when used.

BRIEF DESCRIPTION OF THE DRAWINGS

The embodiments, together with further objects and advantages thereof, may best be understood by making reference to the following description taken together with the accompanying drawings, in which.

DETAILED DESCRIPTION

The present invention generally relates to re-coating of razor blades, and in particular to a method and devices for PTFE re-coating of razor blades.

Figure 2:
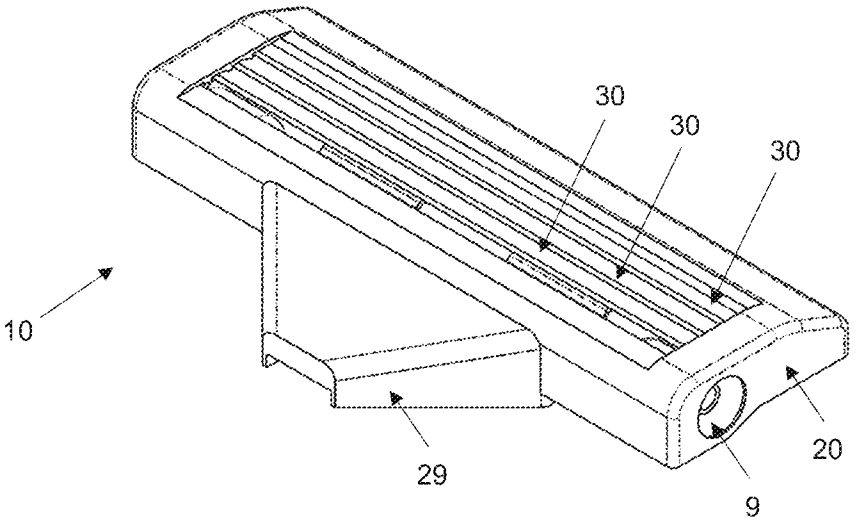
FIG. 2 schematically illustrates a razor cartridge.
Figure 1:
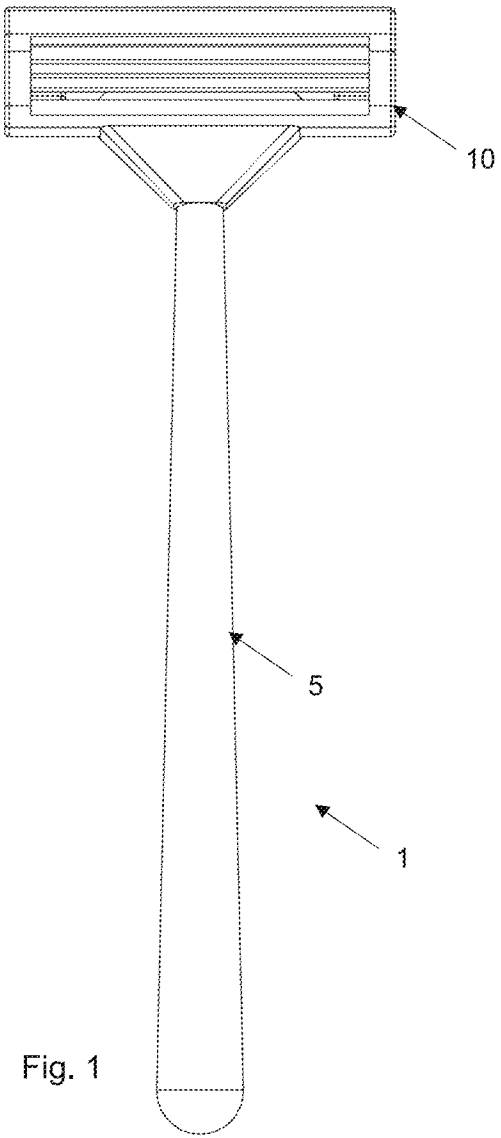
FIG. 1 schematically illustrates an example of a refill cartridge razor.

Razors are used by a large portion of the adult population, both men and women, for personal grooming care. Razors come in two main versions, electric razors and non-electric razors. The latter ones could be entirely disposable but the majority of these razors are so-called refill cartridge razors as schematically shown in FIG. 1. Such a refill cartridge razor 1 basically consists of a reusable handle 5 that is fitted with a new razor cartridge 10 when the old one is worn out.

Although such refill cartridge razors are generally more environmentally friendly as compared to disposable razors in the long run due to the re-use of the handle and thereby merely exchanging razor cartridges, they still have an impact on the environment since they are hard to recycle or dispose in an environmentally friendly way. The reason for this is that the razor cartridge consists of different parts made of different materials. Generally, a razor cartridge comprises a plastic cartridge housing, body or base, one or more razor blades typically made of stainless steel, a retention spring for the razor blades, which is often in metal, a rubber strip, a hydration strip and a plastic cartridge holder that attaches the razor cartridge to the re-usable handle. The various materials of the components of the razor cartridge make it very hard, if not impossible, to recycle the razor cartridge after usage for the consumer. In the best scenario, the used razor cartridge ends up in facilities for waste to energy management or directly transferred to landfills.

The components of the razor cartridge are most often not worn out once the consumer disposes the razor cartridge. Hence, the razor cartridge could be re-used if refurbished. A key step in such a razor cartridge refurbishment is to re-coat the edges of the razor blades as the coating applied to the razor blades during manufacture will at least partly wear off during use.

In the art, polytetrafluoroethylene (PTFE) (TEFLON®) coating is applied to at least the edges of razor blades to improve the shaving effectiveness of the razor blades. In particular, the PTFE coating decreases the pull to cut hair, i.e., decreases the force required to cut the hair, and thereby improves the ease and smoothness of shaving. Hair proteins, in particular keratin, tend to adhere to the material of the razor blade, such as stainless steel, if uncoated. This causes a pulling at the hair follicle during shaving. The PTFE coating reduces this adherence between razor blades and the hair proteins.

Thus, there is therefore a need to re-coat edges of razor blades in a razor cartridge if the razor blades and the razor cartridge is to be re-used.

Figure 8:
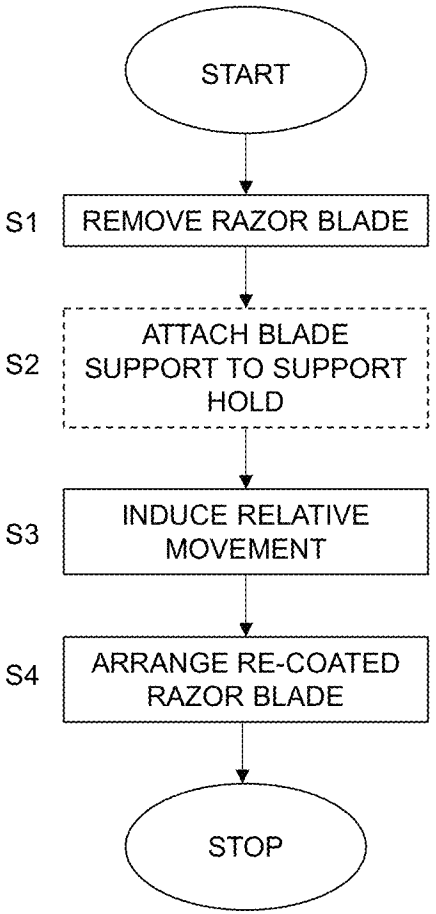
FIG. 8 is a flow chart illustrating a method for re-coating a razor blade of a razor cartridge according to an embodiment.

FIG. 8 is a flow chart illustrating a method for re-coating a razor blade 30 of a razor cartridge 10 according to an embodiment. The method comprises removing the razor blade 30 attached to a blade support 40 from a housing 20 of the razor cartridge 10 in step S1. A next step S3 comprises inducing a relative movement between a PTFE material and an edge 32 of the razor blade 30 attached to the blade support to deposit PTFE onto at least a portion of a surface of the edge 32 of the razor blade 30 to form a re-coated razor blade 30 attached to the blade support 40. The method further comprises arranging the re-coated razor blade 30 attached to the blade support 40 into a housing 20 of a razor cartridge 10.

The method as disclosed in FIG. 8 thereby enables re-coating of previously PTFE-coated razor blades 30 following use of the previously PTFE-coated razor blades 30. The re-coating thereby deposits a fresh PTFE coating onto the edge 32 of the razor blade 30 to complement or replace the previous PTFE coating that has been worn out during use of the razor cartridge 10. The razor blade 30 re-coated with PTFE can then be re-used and will provide an easy and smooth shaving experience due to the added PTFE-coating.

In a typical embodiment, a razor cartridge 10 comprises multiple, i.e., at least two razor blades 30 as shown in FIGS. 2, 3A-3B and 5. For instance, the razor cartridge 10 could comprise at least two razor blades 30, preferably at least three razor blades 30 or even more, such three, four, five or even more razor blades 30. In a particular embodiment, the razor cartridge 10 comprises three razor blades 30 as indicated in FIGS. 2, 3A-3B and 5.

In such an embodiment, step S1 could comprise removing multiple razor blades 30 attached to a respective blade support 40 from the housing 20 of the razor cartridge 10. Step S3 comprises, in this embodiment, inducing a relative movement between the PTFE material and a respective edge 32 of the multiple razor blades 30 attached to the respective blade supports 40 to deposit PTFE onto at least a portion of a respective surface of the edges 32 of the razor blades 30 to form multiple re-coated razor blades 30 attached to the blade supports 40. Step S4 comprises, in this embodiment, arranging the multiple re-coated razor blades 30 attached to the blade supports 40 into a housing 20 of a razor cartridge 10.

In a particular embodiment, step S1 of FIG. 8 comprises removing all razor blades 30 from the housing of the razor cartridge 10. In such an embodiment, all razor blades 30 of the razor cartridge 10 are re-coated in step S3 and then the re-coated razor blades 30 are arranged into the housing 20 of a razor cartridge 10 in step S4.

In another particular embodiment, an inspection, such as visual, mechanical or optical inspection, is first made of the razor blades 30 in the razor cartridge 10 to determine whether all or merely a portion of the razor blades 30 need to be re-coated. For instance, if the razor cartridge 10 comprises three razor blades 30 as shown in FIGS. 2, 3A-3B, 5, the PTFE coatings might have been at least partly worn out for two of the razor blades 30, whereas the PTFE coating is almost intact for the third razor blade 30. In such a case, only two of the razor blades 30 need to re-coated in the method of FIG. 8.

Figure 7:
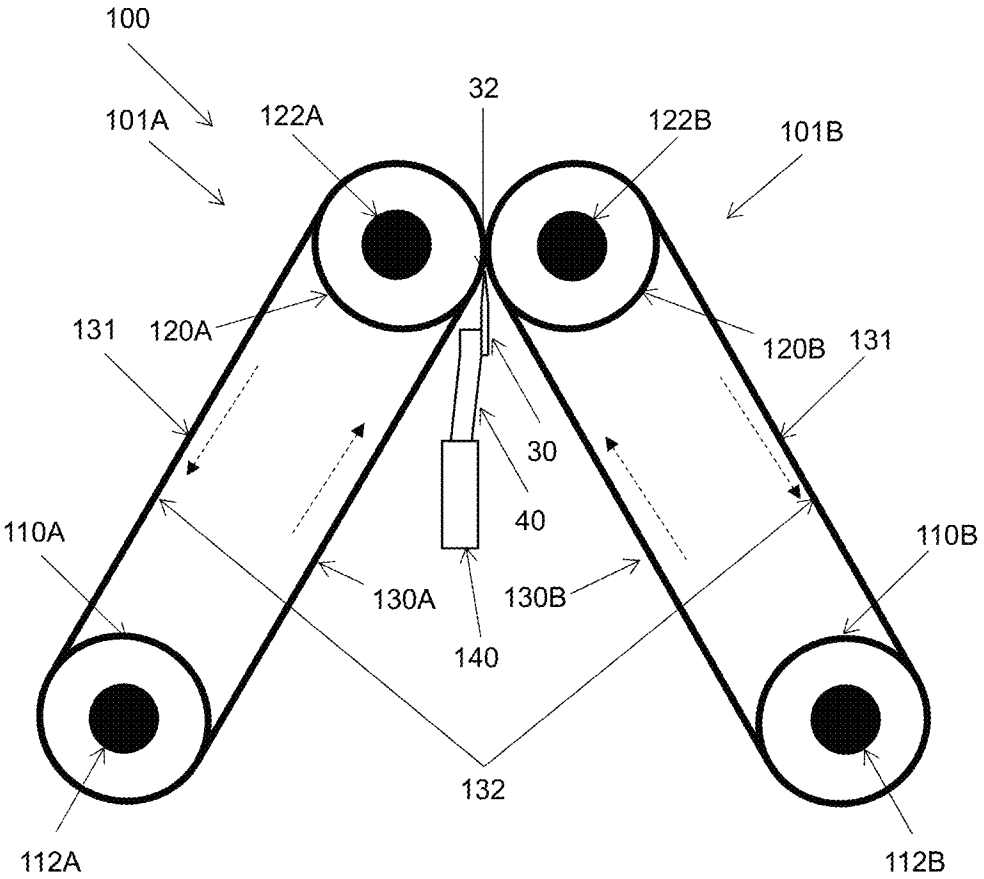
FIG. 7 schematically illustrates a device for re-coating a razor blade of a razor cartridge according to another embodiment.

Hence, in an embodiment, the razor cartridge 10 comprises multiple razor blades 30. The method also comprises inspecting a PTFE coating of the multiple razor blades 30 and identifying at least one razor blade 30 of the multiple razor blades 30 having an at least partly worn-out PTFE coating. In such an embodiment, steps S1, S3 and S4 of FIG. 7 are preferably only performed for the identified at least one razor blade 30 having an at least partly worn-out PTFE coating.

In an embodiment, step S4 comprises arranging the re-coated razor blade 30 attached to the blade support 40 into the housing 20 of the razor cartridge 10 from which the razor blade 30 was removed in step S1.

In this embodiment, the re-coated razor blade(s) 30 is (are) mounted or arranged in the same housing 20 and razor cartridge 10 in step S4 from which the razor blade(s) 30 was (were) dismantled or removed in step S1.

Figure 3B:
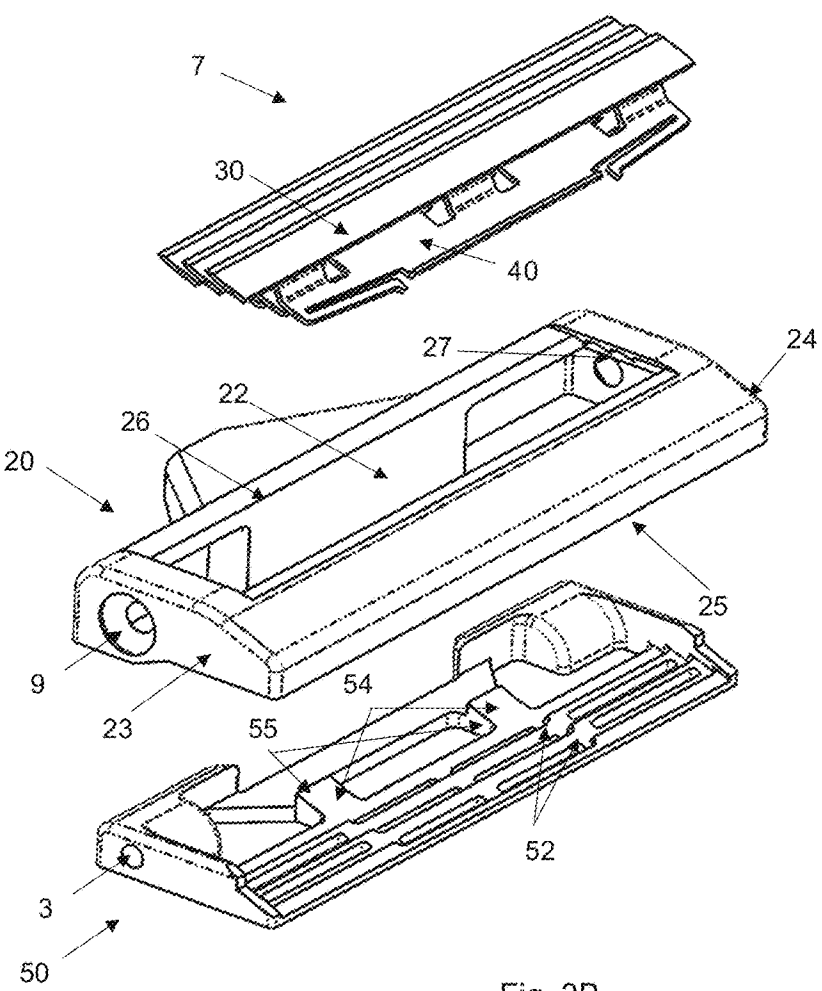
FIGS. 3A and 3B schematically illustrate a dissembled razor cartridge as seen from below (A) and from above (B)
Figure 3A:
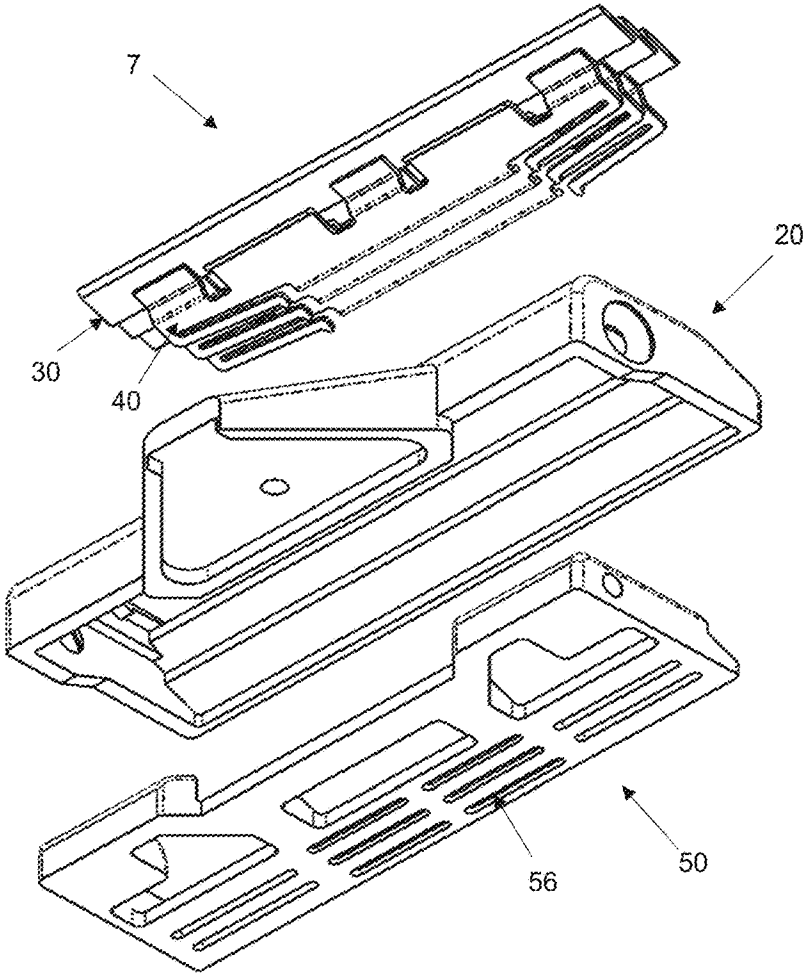

This then means that not only razor blade(s) 30 but also the housing 20 and preferably also other components of the razor cartridge 10, such as bottom cover 50, see FIGS. 3A-3B, are re-used.

Alternatively, if housing 20 of the razor cartridge 10 is deemed to be unsuitable for refurbishment and is thereby discarded, then the re-coated razor blade(s) 30 could be arranged into a new housing 20 of a new razor cartridge 10 in step S4. In this case, at least the one or more razor blades 30 will be re-used, whereas remaining components of the used razor cartridge 10 are discarded.

In an embodiment, the method in FIG. 8 comprises an additional step S2. This step S2 comprises attaching the blade support(s) 40 to a support holder 140, 240, see FIGS. 6B and 7, to position the edge(s) 32 of the razor blade(s) 30 attached to the blade support(s) 40 into contact with the PTFE material. In such an embodiment, step S3 preferably comprises moving the PTFE material relative to the edge(s) 32 of the razor blade(s) 30 attached to the blade support(s) 40.

In this embodiment, one or more razor blades 30 are attached to a support holder 140, 240 through the blade supports 40. For instance, the support holder 140, 240 is then configured to support the razor blade(s) 30 through the blade support(s) 40 and position the edge(s) 32 of the razor blade(s) 30 into contact with the PTFE material.

In this embodiment, the relative movement between the PTFE material and the edge(s) 32 of the razor blade(s) 30 is preferably achieved by moving the PTFE material relative to the razor blade(s) 30. Hence, the razor blade(s) 30 are preferably stationary during the re-coating process while the PTFE material is moving relative to the razor blade(s) 30.

In another embodiment, the relative movement between the PTFE material and the edge(s) 32 of the razor blade(s) 30 is achieved by moving the razor blade(s) 30 relative to the PTFE. Hence, the PTFE material is preferably stationary during the re-coating process while the razor blade(s) 30 are moving relative to the PTFE material.

In a further embodiment, both the PTFE material and the razor blade(s) 30 are moved relative to each other. In this embodiment, both the PTFE material and the razor blade(s) are moving during the re-coating process.

Figure 6B:
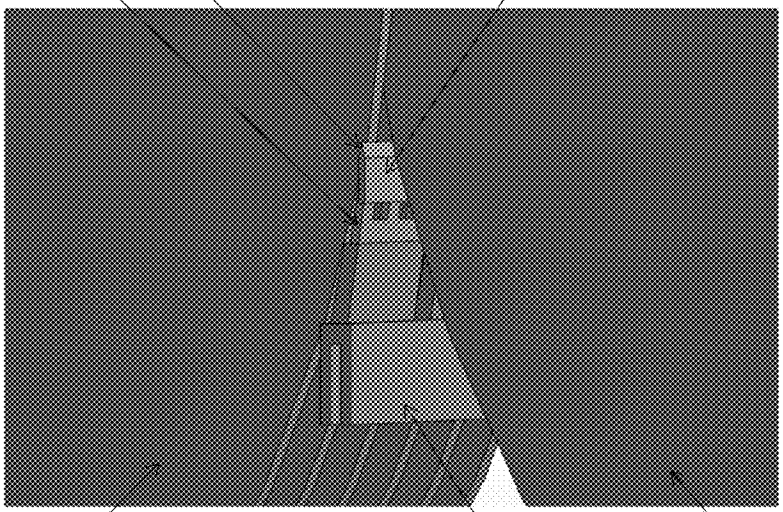
FIGS. 6A and 6B schematically illustrates a device for re-coating a razor blade of a razor cartridge according to an embodiment.
Figure 6A:
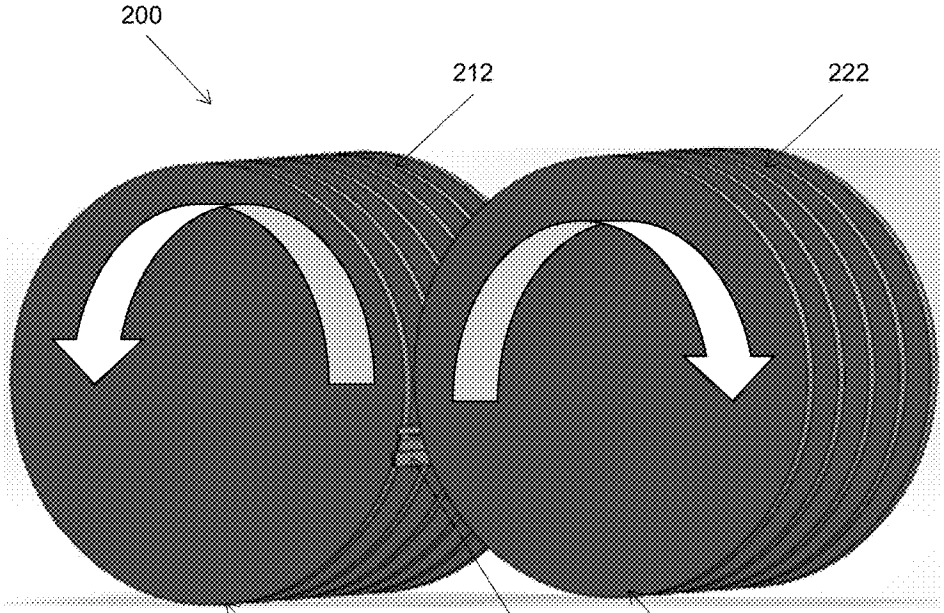
Figure 9:
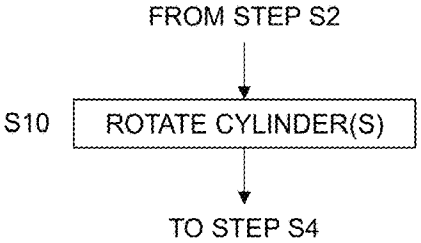
FIG. 9 is a flow chart illustrating an embodiment of the inducing step in FIG. 8.

In an embodiment, see FIGS. 6A and 6B and 9, step S3 in FIG. 8 is performed as shown in step S10 of FIG. 9. This step S10 comprises rotating, relative to the edge(s) 32 of the razor blade(s) 30 attached to the blade support(s) 40, a cylinder 210, 220 comprising a lateral surface 212, 222 comprising the PTFE material.

In this embodiment, at least one cylinder 210, 220 is used as "coating wheel" to physically or mechanically deposit PTFE to at least a portion of the edge(s) 32 of the razor blade(s) 30 while being supported by the support holder 240 through the blade support(s) 40. In FIGS. 6A and 6B, re-coating of a single razor blade 30 is shown. However, it is possible to use long cylinder(s) 210, 220 so that the support holder 240 may carry multiple razor blades 30 attached next to each other in the support holder 240 and thereby re-coat multiple razor blades 30 in parallel. The length of the cylinder(s) 210, 220 is (are) then at least equal to, but preferably longer than, the combined width of the razor blades 30 simultaneously attached to the support holder 240.

The one or more cylinder 210, 220 then rotates relative to the edge(s) 32 of the razor blade(s) 30 and will deposit PTFE material from its lateral surface(s) 212, 222 comprising the PTFE material onto the edge(s) 32 of the razor blade(s) 30.

In an embodiment, a single cylinder 210, 220 is used in the re-coating process. However, it is generally preferred to use two cylinders 210, 220 arranged next to each other as shown in FIGS. 6A and 6B. In such a case, opposite surfaces of the edge(s) 32 of the razor blade(s) 30 can be simultaneously re-coated with PTFE. Furthermore, the two cylinders 210, 220 arranged next to each other with the edge(s) 32 of the razor blade(s) 30 in between reduces the risk of unintentionally bending the thin razor blade(s) 30 during the re-coating process.

In such as an embodiment, step S10 of FIG. 9 comprises rotating, preferably in opposite rotation directions, two adjacent cylinders 210, 220 comprising a respective lateral surface 212, 222 comprising the PTFE material with the edge(s) 32 of the razor blade(s) 30 attached to the blade support(s) 40 arranged in between the two adjacent cylinders 210, 220 to engage the lateral surfaces 212, 222 of the two adjacent cylinders 210, 220.

FIG. 6A schematically indicates the rotation directions of the adjacent cylinders 210, 220 with arrows. The rotation directions are rotations "away" from the edge(s) 32 of the razor blade(s) 30 or expressed differently in the direction "pointed" by the edge(s) 32 of the razor blade(s) 30.

In an embodiment, the lateral surface(s) 212, 222 of the cylinder(s) 210, 220 is (are) coated with the PTFE material. In such an embodiment, the PTFE material is provided on the lateral surface(s) 212, 222, whereas the remaining core part of the cylinder(s) 210, 220 may be made of a material other than the PTFE material.

In an embodiment, the razor blade(s) 30 attached to the blade support(s) 40 may be moved relative to the cylinder(s) 210, 220 during the re-coating process, for instance, by moving the razor blade(s) 30 attached to the blade support(s) 40 along the length of the cylinder(s) 210, 220, such as back-and-forth along this length.

Figure 10:
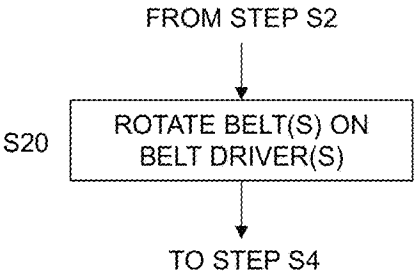
FIG. 10 is a flow chart illustrating another embodiment of the inducing step in FIG. 8.

The embodiments are, however, not limited to usage of the device 200 for re-coating shown in FIGS. 6A and 6B. FIG. 7 illustrates another device 100 that could be used for re-coating. In this embodiment, step S3 of FIG. 8 is preferably performed as shown in step S20 of FIG. 10. This step S20 comprises rotating a belt 130A, 130B of a belt driver 101A, 101B relative to the edge(s) 32 of the razor blade(s) 32 attached to the blade support(s) 40. In such an embodiment, an outer surface 131 of the belt 130A, 130B comprises the PTFE material and is arranged to engage the edge(s) 32 of the razor blade(s) 30 attached to the blade support(s) 40. This outer surface 131 of the belt 130A, 130B is opposite to an inner surface 132 of the belt 130A, 130B engaging pulleys 110A, 110B, 120A, 120B of the belt driver 101A, 101B.

In an embodiment, the device 100 comprises two adjacent belt drivers 101A, 101B as shown in FIG. 7. In such an embodiment, the two adjacent belts 130A, 130B of the two belt drivers 101A, 101B are rotated in opposite direction (see hatched arrows) with the edge(s) 32 of the razor blade(s) 32 attached to the blade support(s) 40 arranged in between the two adjacent belts 130A, 130B to engage the outer surfaces In this embodiment, the belts 130A, 130B with an outer surface 131 of the PTFE material is running between pulleys or drive wheels 110A, 110B, 120A, 120B. At least one of the pulleys 110A, 110B, 120A, 120B comprises a drive shaft 112A, 112B, 122A, 122B connected to at least one motor (not shown) configured to rotate the at least one pulley 110A, 110B, 120A, 120B and thereby causing a rotation of the belts 130A, 130B relative to the razor blade(s) 20 in the support holder 140.

The outer surface 131 of the belts 130A, 130B that is configured to engage the edge(s) 32 of the razor blade(s) 30 when attached to the support holder 140 comprises the PTFE material. For instance, the PTFE material could constitute a surface coating or outer layer of the belts 130A, 130B. In such a case, the belts 130A, 130B may comprise a support layer onto which the PTFE material is coated or onto which the outer PTFE material layer is attached.

The razor blade(s) 30 attached to the support holder 140 may be stationary relative to the rotating belts 130A, 130B during the PTFE re-coating. Alternatively, the razor blade(s) 30 attached to the support holder 140 may be moved relative to the rotating belts 130A, 130B during the PTFE re-coating. For instance, the support holder 140 could be moved along a direction or axis substantially perpendicular to the rotation directions of the belts 130A, 130B, such as back and forth along the width of the rotating belts 130A, 130B.

In a preferred embodiment, the belts 130A, 130B are made of the PTFE material. Hence, in this embodiment, the complete belts 130A, 130B are preferably made of the PTFE material.

Rotation of the belts 130A, 130B via the pulleys 110A, 110B, 120A, 120B, of which at least one is a driver pulley and the other may optionally be a driven pulley, in step S20 causes mechanical or physical deposition of PTFE from the PTFE material from the outside surface 131 of the belts 130A, 130B onto the edge(s) 32 of the razor blade(s) 30. Hence, a re-coating of the edge(s) 32 of the razor blade(s) 30 is achieved.

It is generally preferred to have two belt drivers 101A, 101B arranged next to each other as shown in FIG. 7 to thereby simultaneously engages both sides of the edge(s) 32 of the razor blade(s) 30. Such an approach reduces the risk of unintentionally bending or deforming the razor blade(s) 30 during the re-coating process.

A further embodiment of re-coating the edge(s) 32 of razor blade(s) 30 could be to use rotating brushes comprising bristles, wires or other filaments made of the PTFE material or comprising a respective outer surface comprising the PTFE material. In such an embodiment, the brushes could be arranged next to each other as shown for the two cylinders 210, 220 in FIG. 6A with the edge(s) 32 of the razor blade(s) 32 attached to the blade support(s) 40 arranged in between the two adjacent brushes. The bristles, wires or other filaments of the two brushes will then engage the edge(s) 32 of the razor blade(s) 30 to deposit PTFE material onto the edge(s) 32.

In an embodiment, the brushes could be polishing brushes with bristles, wires or other filaments made of the PTFE material or comprising a respective outer surface comprising the PTFE material.

It is generally preferred to have two brushes arranged next to each other to thereby simultaneously engages both sides of the edge(s) 32 of the razor blade(s) 30. Such an approach reduces the risk of unintentionally bending or deforming the razor blade(s) 30 during the re-coating process.

An advantage of the razor blade re-coating of the invention is that the PTFE material not only re-coats edges 32 of razor blades 30 but may also polishes the edges 32 of the razor blades 30. This means that burring of the edges 32 can be at least partly corrected by polishing in connection with mechanically depositing PTFE from the PTFE material onto the edges 32 of the razor blades 30.

Figure 11:
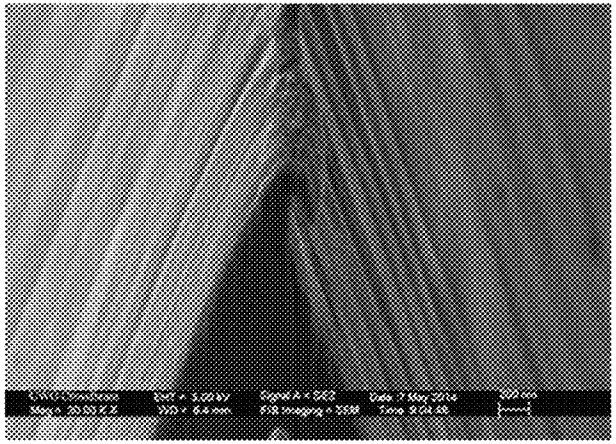
FIG. 11 shows an edge of a razor blade with burring following use.

FIG. 11 illustrates a razor blade edge with burring as a result of use. The PTFE re-coating of the invention could correct such burring by polishing the edges 32 of the razor blades 30 in addition to depositing PTFE onto the edges 32.

In such an embodiment, step S3 of FIG. 8 comprises grinding, honing or polishing the edge(s) 32 of the razor blade(s) 30 while depositing PTFE to at least the portion of the surface(s) of the edge(s) 32 of the razor blade(s) 30 by inducing the relative movement between the PTFE fiber material and the edge(s) 32 of the razor blade(s) 30 attached to the blade support(s) 40.

Various types of PTFE materials could be used according to the embodiments including, but not limited to, solid PTFE material, a material having a PTFE coating onto a non-PTFE material and PTFE fiber material.

In an embodiment, the PTFE material is a PTFE fiber material comprising PTFE fibers and/or fibers having a PTFE surface coating.

In an embodiment, the PTFE fiber material comprises fibers extending along multiple different directions in the PTFE fiber material. The fibers in the PTFE fiber material preferably extend along different axes in addition to the rotation direction of the belt 130 in FIG. 7 or the cylinder(s) 210, 220 in FIGS. 6A and 6B. The different fiber axes in the PTFE fiber material means that burring in the edges 32 of the razor blades 30 is addressed from several angles during the combined polishing and re-coating operation, which in turn more effectively corrects the burring.

In an embodiment, the PTFE fiber material comprises PTFE fibers. Hence, in this embodiment, at least a portion of the fibers in the PTFE fiber material is made of PTFE fibers. The PTFE fiber material may optionally also comprise other non-PTFE fibers, such as bulk fibers, support fibers, etc., in addition to the PTFE fibers. PTFE fibers as used herein means fibers made of PTFE, preferably made solely of PTFE fibers.

In another embodiment, the PTFE fiber material comprises fibers having a fiber core made of a material other than PTFE and a fiber sheath or coating comprising PTFE around the fiber core. In this embodiment, the PTFE fiber material comprises so-called bicomponent (bico) fibers having a non-PTFE fiber core and a PTFE sheath or coating around the non-PTFE fiber core.

In an embodiment, the non-PTFE fiber core could be made of a material selected from the group consisting of fiberglass, poly-paraphenylene terephthalamid (KEVLAR®), and a combination thereof.

In an embodiment, the PTFE fiber material is selected from the group consisting of a PTFE coated fiberglass fabric, a PTFE coated KEVLAR® (poly-paraphenylene terephthalamid) fabric and a combination thereof.

Illustrative, but non-limiting, examples of PTFE fiber materials that could be used according to the invention include a PTFE belt as provided by Esone (https://www.ptfe-fabrics.com/ptfe-belt/), a TEFLON® coated fabric as provided by Tempro Tec Inc. (https://www.temprotec.com/wp-content/uploads/2016/09/FCF1650CTeflon-Cloth-TDS.pdf), a TEFLON® coated mesh fiberglass cloth as provided by Huili fiber glass (https://www.hlinsectscreen.com/white-silicone-ptfe-teflon-coated-mesh-fiberglass-cloth.html), or a PTFE coated glass fabric as provided by Fiberflon (https://www.fiberflon.de/Products/PTFE-Coated-Glass-Fabrics/Page-288-17.aspx).

In an embodiment, the PTFE fiber material is a woven PTFE fiber material. In another embodiment, the PTFE fiber material is a non-woven PTFE fiber material.

The present invention also relates to a device 100 for re-coating a razor blade 30 of a razor cartridge 10, see FIG. 7. The device 100 comprises two belt driver 101A, 101B. Each belt driver 101A, 101B of the two belt drivers 101A, 101B comprises at least two pulleys 110A, 110B, 120A, 120B. At least one pulley 110A, 110B, 120A, 120B of the at least two pulleys 110A, 110B, 120A, 120B is connected to a drive shaft 112A, 112B, 122A, 12B. The belt drivers 101A, 10B also comprise a belt 130A, 130B looped over the at least two pulleys 110A, 110B, 120A, 120B. An outer surface 131 of the belts 130A, 130B comprises a PTFE material and is arranged to engage an edge 32 of a razor blade 30 attached to a blade support 40. The outer surface 131 of the belts 130A, 130B is opposite to an inner surface 132 of the belts 130A, 130B. The inner surface 132 engages the at least two pulleys 110A, 110B, 120A, 120B. The device 100 also comprises a support holder 140 arranged relative to the two belt drivers 101A, 101B to support the razor blade 30 attached to the blade support 40 and position the edge 32 of the razor blade 30 into contact with the PTFE material.

In an embodiment, the device 100 further comprises at least one motor (not shown) connected to the at least one drive shaft 112A, 112B, 122A, 122B and arranged to drive or rotate the at least one drive shaft 112A, 112B, 122A, 122B. Rotation of the at least one drive shaft 112A, 112B, 122A, 122B causes rotation of the connected pulley(s) 110A, 110B, 120A, 120B and thereby a rotation of the belts 130A, 130B relative to the support holder 140 and its attached razor blade(s) 20.

A pulley 110A, 110B, 120A, 120B having a drive shaft 112A, 112B, 122A, 122B connected to a motor is generally denoted driver pulley in the art, whereas a pulley that is not connected to any motor through a drive shaft is generally denoted driven pulley.

In an embodiment, the belt 130 is composed of the PTFE material.

FIGS. 6A and 6B illustrate another embodiment of a device 200 for re-coating a razor blade 30 of a razor cartridge 10. The device 200 comprises two rotatable cylinders 210, 220 comprising a respective lateral surface 212, 222 comprising a PTFE material. The device 200 also comprises a support holder 240 arranged relative to the two rotatable cylinders 210, 220 to support a razor blade 30 attached to a blade support 40 and position an edge 32 of the razor blade 30 between the two rotatable cylinders 210, 220 and into contact with the PTFE material. The device 200 further comprises a motor connected to the two rotatable cylinders 210, 220 and configured to rotate the two rotatable cylinders, preferably in opposite rotation directions.

In an embodiment relating to the devices 100, 200 in FIGS. 6A to 7, the PTFE material is a PTFE fiber material comprising PTFE fibers and/or fibers having a PTFE surface coating.

In an embodiment relating to the devices 100, 200 in FIGS. 6A to 7, the PTFE fiber material comprises fibers extending along multiple different directions in the PTFE fiber material.

In an embodiment relating to the devices 100, 200 in FIGS. 6A to 7, the PTFE fiber material comprises PTFE fibers.

In another embodiment relating to the devices 100, 200 in FIGS. 6A to 7, the PTFE fiber material comprises fibers having a fiber core made of a material other than PTFE and a fiber sheath or coating comprising PTFE around the fiber core.

In a particular embodiment relating to the devices 100, 200 in FIGS. 6A to 7, the PTFE fiber material is selected from the group consisting of a PTFE coated fiberglass fabric, a PTFE coated KEVLAR® fabric and a combination thereof.

Various embodiments described in the foregoing in connection the method also applies mutatis mutandis to the devices 100, 200 shown in FIGS. 6A to 7.

FIG. 1 illustrate a razor 1 comprising a razor handle 5 and a razor cartridge 10 attached to the razor handle 5. The razor cartridge 10, which is more clearly shown in FIGS. 2, 3A-3B and 5, comprises razor blade assemblies 7 that are arranged in the razor cartridge 10 in such a way that they can be dismantled from the razor cartridge 10 and then be arranged back into razor cartridge 10 following re-coating of the razor blades 30 in the razor blade assemblies 7.

Such a razor cartridge 10 comprises a housing 20, a bottom cover 50 and multiple razor blade assemblies 7. The bottom cover 50 comprises multiple steps 52. Each razor blade assembly 7 of the multiple razor blade assemblies 7 is arranged on a respective step 52 of the multiple steps 52. Furthermore, each razor blade assembly 7 comprises a blade support 40 and a razor blade 30 attached to the blade support 40. The blade support 40 comprises a first main surface 41 and a second main surface 42 opposite to the first main surface 41. The blade support 40 also comprises at least one upwardly protruding member 43 and at least one downwardly protruding member 44.

The at least one upwardly protruding member 43 of at least one razor blade assembly 7 of the multiple razor blade assemblies 7 is configured to engage a second main surface 41 of a blade support 40 of an adjacent razor blade assembly 7 of the multiple razor blade assemblies 7. Furthermore, the at least one downwardly protruding member 44 of at least one razor blade assembly 7 of the multiple razor blade assemblies 7 is configured to engage a first main surface 42 of a blade support 40 an adjacent razor blade assembly 7 of the multiple razor blade assemblies 7.

Figure 5:
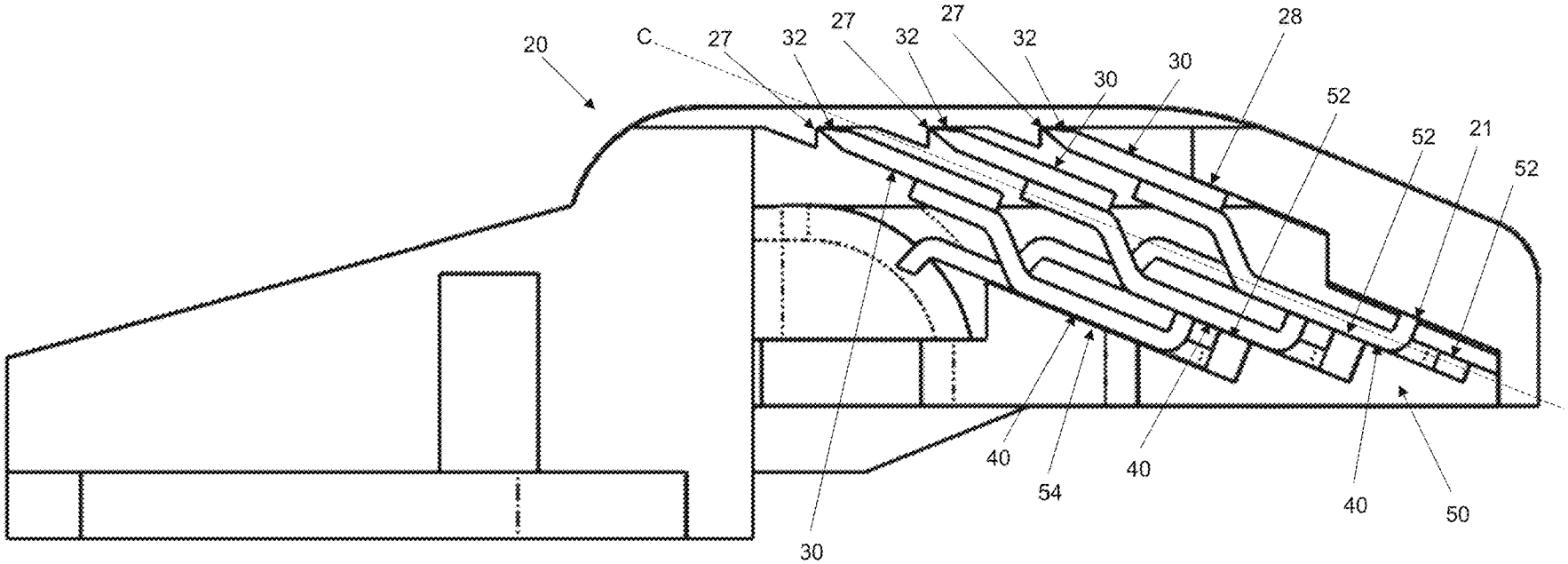
FIG. 5 is a cross-sectional view of a razor cartridge.

As is best seen in FIGS. 3A-3B and 5, the bottom cover 50 comprises multiple, i.e., at least two, steps 52, preferably one such step 52 per razor blade assembly 7 in the razor cartridge 10. The razor blade assemblies 7 are then supported by these steps 52 through their blade supports 40 resting on the steps 62 with at least a portion of the second main surface 42 of the blade supports 40 engaging a respective step 52 and thereby being supported by the respective step 52.

The at least one upwardly protruding member 43 and the at last one downwardly protruding member 44 of the blade supports 40 are configured to engage adjacent blade supports 40 when the razor blade assemblies 8 are arranged on the steps 52. The upwardly and downwardly protruding members 43, 44 thereby support the razor blade assemblies 7 by defining a respective distance between the razor blade assemblies 7 in the razor cartridge 10 and thereby defining a respective distance between the razor blades 30 and the razor edges 32. The distance between razor blades 30 and the razor edges 32 at least partly defined by the upwardly and downwardly protruding members 43, 44 allows water to flow through the razor blades 30 during cleaning of the razor cartridge 10 and thereby reduces the risk of capturing cut hair parts and other debris in the housing 20 of the razor cartridge 10.

In an embodiment, the razor cartridge 10 comprises three razor blade assemblies 7 denoted first razor blade assembly 7, second razor blade assembly 7 and third razor blade assembly 7. In such a case, the at least one upwardly protruding member 43 of the second razor blade 7 assembly is configured to engage the second main surface 41 of the blade support 40 of the first razor blade assembly 7. Correspondingly, the at least one downwardly protruding member 44 of the second razor blade assembly 7 is configured to engage the first main surface 42 of the blade support 40 of the third razor blade assembly 7.

In a particular embodiment, the at least one upwardly protruding member 43 of the first razor blade assembly 7 is configured to engage a support surface 21 of the housing 20, also referred to as first support surface 21 of the housing 20 herein, see FIG. 5. The at least one downwardly protruding member 44 of this first razor blade assembly 7 is configured to engage a first main surface 42 of a blade support 40 of the second razor blade assembly 7.

In another particular embodiment, the at least one upwardly protruding member 43 of the third adjacent razor blade assembly 7 is configured to engage a second main surface 41 of a blade support 40 of the second razor blade assembly 7.

In an embodiment, the bottom cover 50 preferably comprises a support surface 54 configured to engage and support a second main surface 41 of the blade support 40 of the third razor blade assembly 7, see FIGS. 3B and 5.

Hence, in a preferred embodiment, the multiple razor blade assemblies 7 are sandwiched between a support surface 54 of the bottom cover 50 and a support surface 21 of the housing 20 forming a stack of partly displaced razor blade assemblies 7. The upwardly and downwardly protruding members 43, 44 then keep the multiple razor blade assemblies 7 and their included razor blades 30 distanced from each other in the stack. Furthermore, the upwardly and downwardly protruding members 43, 44 arrange the razor blades 30 substantially parallel to each other with the razor edges 32 directed in substantially the same direction.

In an embodiment, the housing 20 also comprises a second support surface 28 that is configured to engage at least a portion of the razor blade 30 of the first razor blade assembly 7, see FIG. 5.

The razor blade assemblies 7 are arranged in the razor cartridge 10 by first placing the third razor blade assembly 7 on the third or lowest step 52 of the bottom cover 50 so that the support surface 54 of a support structure 55 in the bottom cover 50 engages the second or lower main surface 41 of the blade support 40 of the third razor blade assembly 7. The third razor blade assembly 7 thereby rests on and is supported by the third or lowest step 52 and the support structure 55. The second razor blade assembly 7 is then placed on the second or intermediate step 52 of the bottom cover 50. The at least one upwardly protruding member 43 of the third razor blade assembly 7 will then engage and support the second or lower main surface 41 of the blade support 40 of the second razor blade assembly 7, while the at least one downwardly protruding member 44 of the second razor blade assembly 7 engages and is supported by the first or upper main surface 42 of the third razor blade assembly 7. Finally, the first razor blade assembly 7 is pushed in between the second razor blade assembly 7 and the housing 20. In such a case, the at least one upwardly protruding member 43 of the second razor blade assembly 7 will engage and support the second or lower main surface 41 of the blade support 40 of the first razor blade assembly 7, while the at least one downwardly protruding member 44 of the first razor blade assembly 7 engages and is supported by the first or upper main surface 42 of the second razor blade assembly 7. The upwardly protruding member 43 of the first razor blade assembly 7 is then configured to engage the first support surface 21 of the housing 20 while at least a portion of the razor blade 30 of the first razor blade assembly 7 is configured to engage the second support surface 28 of the housing 20.

In a particular embodiment, the at least one upwardly protruding member 43 protrudes a same distance from the first main surface 42 as the at least one downwardly protruding member 44 protrudes from the second main surface 41. In such a particular embodiment, the razor blades 30 of the razor blade assemblies 7 will be arranged substantially parallel to each other in the housing 20 and with substantially a same distance between adjacent razor blades 30.

Hence, the upwardly and downwardly protruding members 43, 44 enable the multiple razor blade assemblies 7 to be arranged on the multiple steps 52 of the bottom cover 50 to position each razor blade 30 at a distance relative adjacent razor blade or blades 30. Preferably, the distance or gap between each razor blade 30 and the adjacent razor blade or blades 30 is the same as the distance that the at least one upwardly protruding member 43 protrudes from the first main surface 42 and the at least one downwardly protruding member 44 protrudes from the second main surface 41.

The upwardly and downwardly protruding members 43, 44 are configured to provide slidable contact with the second and first main surfaces 41, 42 or the first support surface 21 of the housing 21. Correspondingly, the second support surface 28 of the housing 21 provides a slidable contact with the at least a portion of the razor blade 30 of the first razor blade assembly 7 and the support structure 55 of the bottom cover 50 provides a slidable contact with the second main surface 41 of the blade support 40 of the third razor blade assembly 7.

Slidable contact as used herein implies that the multiple razor blade assemblies 7 are movable relative to each other and also relative to the housing 20 and the bottom cover 50. Hence, in an embodiment, each razor blade assembly 7 of the multiple razor blade assemblies 7 is independently movable relative to another blade assembly 7 of the multiple razor blade assemblies 7.

The relative movement of the razor blade assemblies 7 relative to each other and further preferably also relative to the housing 20 and the bottom cover 50 is along an axis C parallel to the extension of the razor blades 30, the blade supports 40 and the razor blade assemblies 7, see FIG. 5.

This relative and independent movement of the razor blade assemblies 7 and their razor blades 30 means that the razor blades 30 will adjust to the contours of the skin of a user during shaving. This is possible by the slidable contacts achieved by the upwardly and downwardly protruding members 43, 44.

Figure 4A:
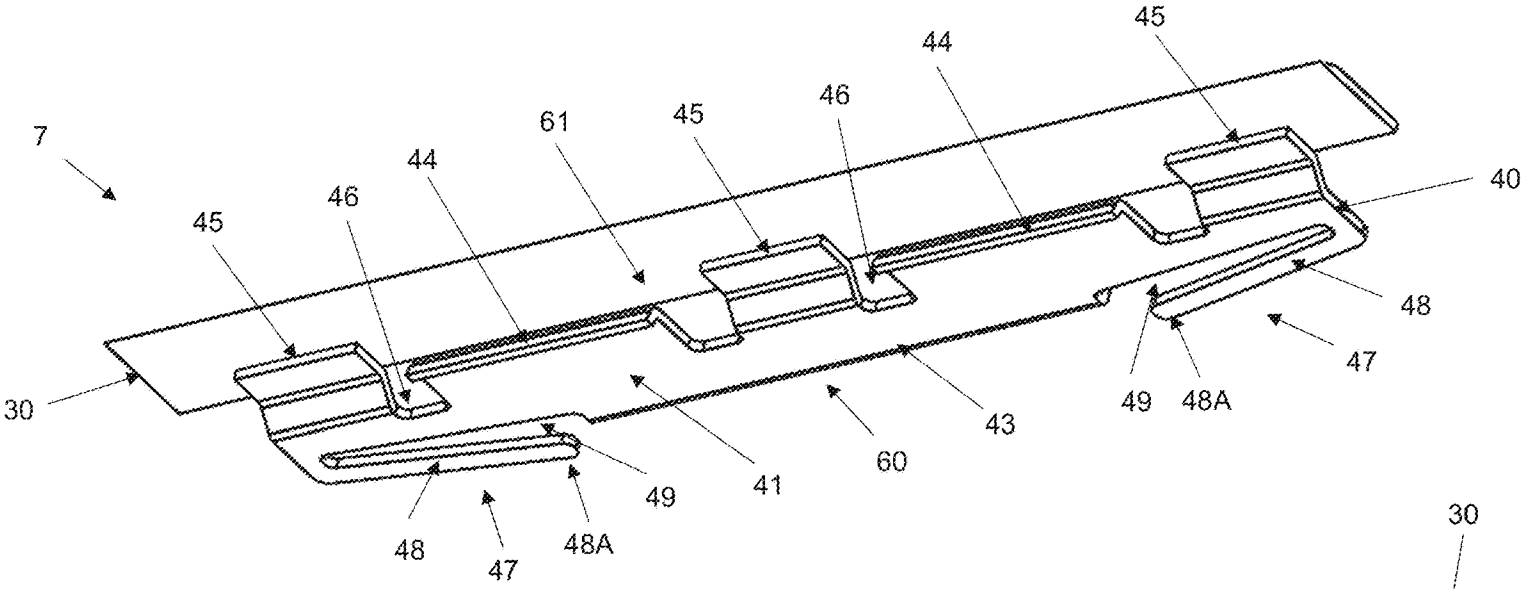
FIGS. 4A and 4B schematically illustrates a razor blade assembly with a razor blade attached to a blade support from below (A) and above (B)
Figure 4B:
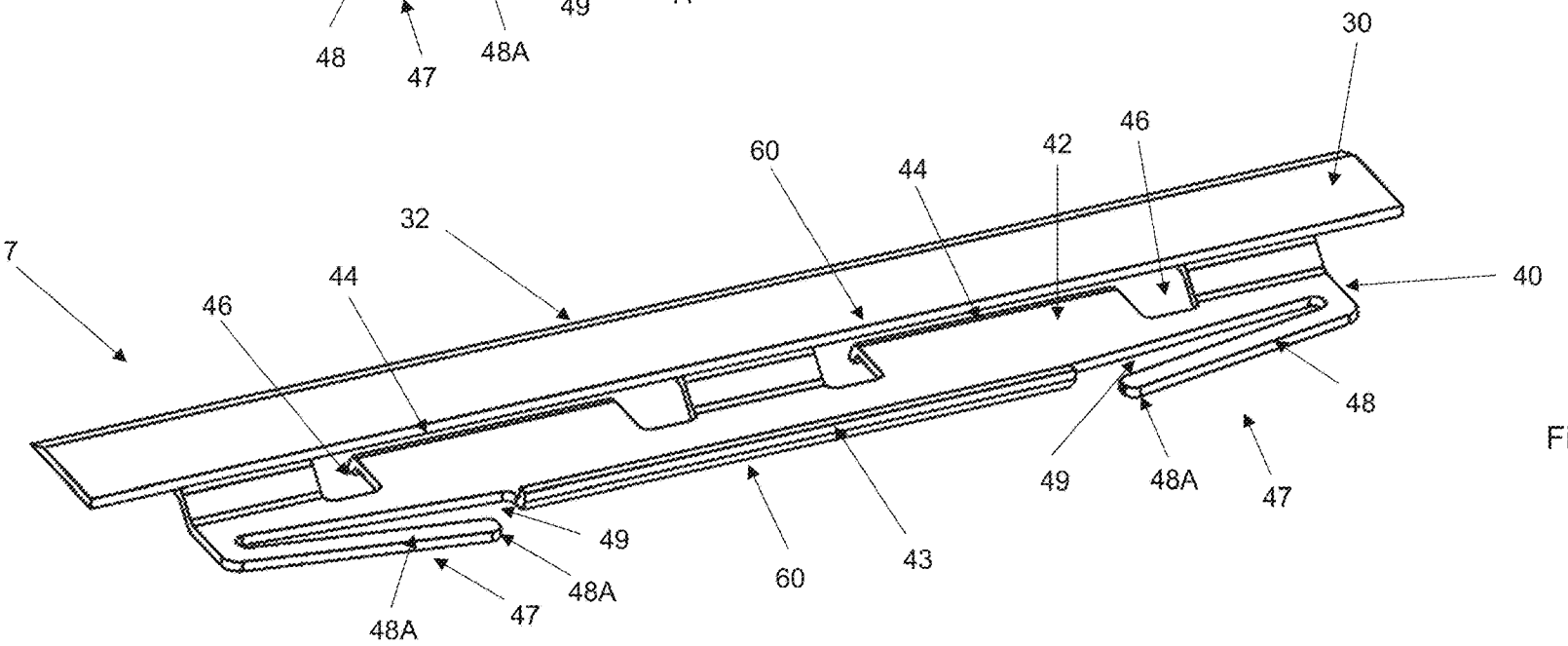

In an embodiment, the razor blade assemblies 7 are furthermore biased or preloaded (spring loaded) by at least one respective spring member 47 configured to engage a respective step 52 in the bottom cover 50 to provide a bias or preload of the razor blade assemblies 7 in the direction of the razor edges 32 of the razor blades 30, see FIGS. 4A and 4B.

Hence, in an embodiment, the blade support 40 comprises at least one spring member 47 configured to engage a step 52 of the multiple steps 52. The at least one spring member 47 there provides a spring force in the direction of the razor edges 32 of the razor blades 30 thereby pushing the razor blade assemblies 7 and the razor blades 30 towards the upper part of the housing 20 and an elongated blade receiving region 22 of the housing 20. This spring force means that the razor edges 32 will always be in correct position relative to the housing 20 to achieve a smooth shaving experience even after re-sharpening of the razor blades 30.

Generally, the razor blades 30 in a new razor cartridge 10 have substantially a same size and thereby extension along the axis C. However, if the razor blades 30 are refurbished, including re-sharpened and/or re-coated, the razor blades 30 may over time have different sizes. The at least one spring member 47 compensates for this change in size of the razor blades 30 following re-sharpening by pushing the razor blades 30 and thereby the razor edges 32 towards the upper part of the housing 20 and the elongated blade receiving region 22. This means that the razor edges 32 will thereby be correctly positioned relative to the housing 20 and have substantially the same blade exposure even after re-sharpening and/or re-coating.

In an embodiment, the at least one spring member 47 comprises at least one elongated segment 48 forming at least one laterally extending slotted opening 49 in the blade support 40.

In an embodiment, each blade support 40 comprise two spring members 47, preferably in the form of two elongated segments 48 forming two laterally extending slotted openings 49 in the blade support 40. In such a case, the elongated segments 48 are formed such that a free end 48A of the elongated segments 48 extends laterally and outwardly from the blade support 40.

The elongated segments 48 extending laterally and outwardly from the blade support 40 act like springs when engaging steps 52 of the bottom cover 50 to push the blade support 40 and the attached razor blades 30 away from the steps 52 and towards the upper part of the housing 20 and the elongated blade receiving region 22.

In a particular embodiment, the at least one upwardly protruding member 43 of the blade support 40 is arranged between the two spring members 47.

An advantage of having the at least one spring member 47 attached to the razor blade 30 through the blade support 40 is that the exposure of each razor blade 30 in the razor cartridge 10 can be individually controlled. This is a significant advantage as compared to razor cartridges where the razor blades in the form of spring fingers. Blade exposure as used herein is the amount of the blade cutting edge 32 are exposed beyond the housing 20.

In an embodiment, the housing 20 comprises an elongated blade receiving region 22 defined between two end walls 23, 24 spaced from each other along a first axis and between two side walls 25, 26 spaced from each other along a second axis perpendicular to the first axis, see FIG. 3B. In this embodiment, the housing 20 also comprises blade-receiving slots 27 in the end walls 23, 24 extending along a third axis that is perpendicular to the first axis A and angled at an angle larger than 0° but smaller than 90° to the second axis.

In such an embodiment, the edge portions of the razor blades 30 are received in the blade-receiving slots 27. These blade-receiving slots 27 thereby prevent or restrict the razor blades 30 from being pushed by the spring members 47 past the correct position of the razor edges 32 relative to the upper part of the housing 20 and the elongated blade receiving region 22. This means that the razor blades 30 and the razor edges 32 will be positioned correctly to achieve a smooth shaving even if the razor blades 30 are re-sharpened.

In an embodiment, the multiple steps 52 of the bottom cover 50 also extend along the third axis. Hence, in this embodiment, the steps 52 are substantially parallel with the blade receiving slots 27.

The above-mentioned third axis that is angled relative to the second axis has a non-zero angle that corresponds to the shaving angle of the razor edges 32 of the razor blades 30. This non-zero angle is preferably larger than 0° but smaller than 45° to the second axis B, preferably selected within an interval of from 5° up to 35°, more preferably selected within an interval of from 10° up to 30°, and even more preferably selected within an interval of from 15° up to 25°, such as about 20°.

In an embodiment, the blade support 40 comprises a first side 60 configured to face a step 52 of the multiple steps 52 and a second side 61 opposite to the first side 60. In such an embodiment, the at least one upwardly protruding member 43 is arranged in connection with the first side 60 and the at least one downwardly protruding member 44 is arranged in connection with the second side 61.

In another embodiment, the at least one upwardly protruding member 43 is arranged in connection with the second side 61 and the at least one downwardly protruding member 44 is arranged in connection with the first side 60.

The upwardly and downwardly protruding members 43, 44 can be achieved by various structures, preferably in connection with the respective sides 60, 61 of the blade supports 40. For instance, the upwardly protruding members 43 could be in the form of a respective structure attached to the first main surfaces 42 (or the second main surface 41) of the blade supports 40, while the downwardly protruding members 42 could be in the form of a respective structure attached to the second main surfaces 41 (or the first main surface 42) of the blade supports 40. The structures then protrude away from the first and main surfaces 41, 42 of the blade supports 40.

In another embodiment, at least a portion of the first side 60 (or the second side 61) of the blade support 40 is bent to form the at least one upwardly protruding member 43 and at least a portion of the second side 61 (or the first side 60) of the blade support 40 is bent to form the at least one downwardly protruding member 44, see FIGS. 4A and 4B. Hence, in this embodiment, at least one portion of the respective side 60, 61 of the blade support 40 is bent to protrude upward past the first main surface 42 or protrude downward past the second main surface 41.

In an embodiment, the blade support 40 comprises at least one support member 45 attached to the razor blade 30. In a particular embodiment, the at least one support member 45 extends from the second side 61 of the blade support 40.

In an embodiment, the blade support 40 comprises multiple support members 45 and multiple downwardly protruding members 44. In a preferred embodiment, the blade support 40 comprises alternating support members 45 and downwardly protruding members 44.

The razor blades 30 are then attached to the support members 45, preferably though the respective lower main surface of the razor blades 30. The razor blades 30 may, for instance, be attached to the support members 45 through welding, such as laser welding.

In a particular embodiment, the blade support 40 comprises slotted openings 46 between adjacent support members 45 and downwardly protruding members 44. These slotted openings 46 thereby provide passages for water, cut hair and other debris during cleaning of the razor cartridge 10. This means that water can flow in between the razor blades 30 and further through the slotted openings 46 and leave the razor cartridge 10 through channels 56 in the bottom cover 50. Hence, the bottom cover 50 preferably comprises at least one channel 56 extending through the thickness of the bottom cover 50. The at least one channel 56 preferably extend along at least a major part of the length of the bottom cover 50. Alternatively, multiple channels 56 could be provided, such as side by side, along the length of the bottom cover 50 so that each channel 56 then merely extends along a portion of the length of the bottom cover 50.

The design of the razor cartridge 10 allows for an efficient cleaning following use by providing passages for water during rinsing to flow between the razor blades 30 through the slotted openings 46 between the support members 45 and the downwardly protruding members 44 in the blade supports 40 and further between the blade supports 40 distanced from each other by the upwardly and downwardly protruding members 43, 44 and then leaving the razor cartridge 20 through the at least one, preferably multiple, channels 56 in the bottom cover 50.

In an embodiment, the bottom cover 50 is releasably attached to the housing 20. This means that the bottom cover 50 can be released or removed from the housing 10 to thereby provide access to the included razor blade assemblies 7. The razor blade assemblies 7 can then be retrieved from the opened razor cartridge 10 to refurbish the razor blades 30 of the razor blade assemblies 7. The bottom cover 50 can be releasably attached to the housing 20 according to various embodiments. For instance, the housing 20 can include a respective opening 9 in both end walls 23, 24, see FIGS. 2, 3B. In such an embodiment, the bottom cover 50 comprises matching openings 3 in its end walls as shown in FIG. 3B. These matching openings 3 are then aligned with the openings 9 in the end walls 23, 24 of the housing 20, when the bottom cover 50 is attached to the housing 20. In a preferred embodiment, the matching openings 3 in the end walls of the bottom cover 50 are preferably threaded openings 3. In such a case, the bottom cover 50 could be secured to the housing 20 by a respective screw inserted and screwed into the openings 9 and threaded openings 3. The bottom cover 50 can then be released from the housing 20 to access the razor blade assemblies 7A-7C provided therein by unscrewing the screws 7 and then remove the housing 20 from the bottom cover 50. The embodiments are, however, not limited to such a way to releasably attach the bottom cover 50 to the housing 20. Other examples include using snap-fit connectors. In such a case, the snap-fit locking mechanism could be an annular snap-fit lock, a torsional snap-fit lock or a cantilever snap-fit lock.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A method for re-coating a razor blade of a razor cartridge, the method comprising the steps of:

S1) Removing the razor blade attached to a blade support from a housing of the razor cartridge;

S3) inducing a relative movement between a polytetrafluoroethylene (PTFE) material and an edge of the razor blade attached to the blade support to deposit PTFE from the PTFE material onto at least a portion of a surface of the edge of the razor blade to form a re-coated razor blade attached to the blade support; and S4) arranging the re-coated razor blade attached to the blade support into the housing of the razor cartridge from which the razor blade was removed in step S1) or into a housing of another razor cartridge.

2. The method according to claim 1, wherein step S4) comprises arranging the re-coated razor blade attached to the blade support into the housing of the razor cartridge from which the razor blade was removed in step S1).

3. The method according to claim 1, further comprising attaching the blade support to a support holder arranged to position the edge of the razor blade attached to the blade support into contact with the PTFE material, wherein step S3) comprises the step of S3*a*) moving the PTFE material relative to the edge of the razor blade attached to the blade support.

4. The method according to claim 3, wherein step S3*a*) moving comprises the step of S10) rotating, relative to the edge of the razor blade attached to the blade support, a cylinder comprising a lateral surface comprising the PTFE material.

5. The method according to claim 4, wherein the lateral surface of the cylinder is coated with the PTFE material.

6. The method according to claim 3, wherein step S3*a*) comprises the step of S10) rotating, in opposite rotation directions, two adjacent cylinders comprising a respective lateral surface comprising the PTFE material with the edge of the razor blade attached to the blade support arranged in between the two adjacent cylinders to engage the lateral surfaces of the two adjacent cylinders.

7. The method according to claim 3, wherein step S3*a* comprises the step of S20) rotating a belt of a belt driver relative to the edge of the razor blade attached to the blade support, wherein an outer surface of the belt comprises the PTFE material and is arranged to engage the edge of the razor blade attached to the blade support, and wherein the outer surface of the belt is opposite to an inner surface of belt engaging pulleys of the belt driver.

8. The method according to claim 7, wherein the belt is made of the PTFE material.

9. The method according to claim 3, wherein step S3*a*) comprises the step of S20) rotating, in opposite rotation directions, two adjacent belts of two belt drivers with the edge of the razor blade attached to the blade support arranged in between the two adjacent belts to engage the outer surfaces of the two adjacent belts.

10. The method according to claim 1, wherein the PTFE fiber material comprises fibers extending along multiple different directions in the PTFE fiber material.

11. The method according to claim 10, wherein step S3) comprises polishing the edge of the razor blade while depositing PTFE from the PTFE material to at least the portion of the surface of the edge of the razor blade by inducing the relative movement between the PTFE fiber material and the edge of razor blade attached to the blade support.

12. The method according to claim 1, wherein the PTFE material is a PTFE fiber material comprising PTFE fibers and/or fibers having a PTFE surface coating.

13. The method according to claim 12, wherein the PTFE fiber material comprises PTFE fibers.

14. The method according to claim 12, wherein the PTFE fiber material comprises fibers having a fiber core made of a material other than PTFE and a fiber sheath or coating comprising PTFE around the fiber core.

15. The method according to claim 14, wherein the PTFE fiber material is selected from the group consisting of a PTFE coated fiberglass fabric, a PTFE coated KEVLAR® fabric, and a combination thereof.

16. The method according to claim 12, wherein the PTFE fiber material is a woven PTFE fiber material.

* * * * *